US009093785B2

(12) United States Patent
Yu et al.

(10) Patent No.: US 9,093,785 B2
(45) Date of Patent: Jul. 28, 2015

(54) ELECTRICAL CONNECTOR WITH DUAL LATCH MEMBERS

(71) Applicant: ALLTOP ELECTRONICS (SUZHOU) LTD., Taicang, JiangSu Province (CN)

(72) Inventors: Wang-I Yu, Jhonghe (TW); Hung-Chi Tai, Jhonghe (TW); Yung-Chih Hung, Jhonghe (TW); Chieh-Yu Cheng, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 92 days.

(21) Appl. No.: 13/861,492

(22) Filed: Apr. 12, 2013

(65) Prior Publication Data

US 2014/0220809 A1 Aug. 7, 2014

(30) Foreign Application Priority Data

Feb. 5, 2013 (CN) ..... 2013 1 0045162

(51) Int. Cl.
*H01R 13/627* (2006.01)

(52) U.S. Cl.
CPC ..... *H01R 13/6273* (2013.01)

(58) Field of Classification Search
CPC ..... H01R 13/6275
USPC ..... 439/358, 357
See application file for complete search history.

(56) References Cited

U.S. PATENT DOCUMENTS

| | | | | |
|---|---|---|---|---|
| 6,592,409 | B1 * | 7/2003 | Oehme et al. | 439/680 |
| 6,945,825 | B2 * | 9/2005 | Aramoto et al. | 439/680 |
| 7,189,099 | B2 * | 3/2007 | Whyne et al. | 439/358 |
| 7,261,584 | B2 * | 8/2007 | Jedynski et al. | 439/368 |

* cited by examiner

*Primary Examiner* — Phuong Dinh
(74) *Attorney, Agent, or Firm* — Sughrue Mion, PLLC

(57) ABSTRACT

An electrical connector includes an insulative housing, a number of contacts retained in the insulative housing and a pair of latch members located at lateral sides of the insulative housing. The insulative housing includes a mating portion, a mounting portion and a number of passageways extending therethrough to receive the contacts. Each latch member includes a pivot portion connected to corresponding lateral side of the insulative housing, a locking arm extending forwardly from the pivot portion and a driving portion extending backwardly from the pivot portion. The locking arms are capable of pivoting outwardly along a horizontal direction to a release status under condition that the driving portions are inwardly pressed. With the dual latch members, the electrical connector can be much reliable in locking with a mateable connector.

19 Claims, 7 Drawing Sheets

ELECTRICAL CONNECTOR WITH DUAL LATCH MEMBERS

BACKGROUND OF THE INVENTION

1. Field of the Invention

The present invention relates to an electrical connector, and more particularly, to a cable connector with dual latch members for stably locking with a mateable connector.

2. Description of Related Art

A U.S. Patent issued on Jun. 8, 2010 discloses a cable connector including an insulative housing and a plurality of contacts retained in the insulative housing. The insulative housing includes a plurality of passageways extending therethrough to receive the contacts. The insulative housing includes a latch member on one side thereof. The latch member includes a connecting portion connected to the insulative housing, a locking arm extending from one end of the connecting portion and a pressing portion extending from the other end of the connecting portion. When the pressing portion gets pressed by external force, the locking arm moves outwardly to unlock with a mateable connector. However, the conventional cable connector is only provided with a single-side locking arm which may render unstable locking status during mating with the mateable connector. Besides, the single-side locking arm is easily broken with the connecting portion connected to top and bottom walls of the insulative housing.

Hence, an electrical connector with an improved latch member is desired.

BRIEF SUMMARY OF THE INVENTION

The present invention provides an electrical connector including an insulative housing, a plurality of contacts retained in the insulative housing and a pair of latch members located at lateral sides of the insulative housing. The insulative housing includes a mating portion, a mounting portion at a rear of the mating portion and a plurality of passageways extending through the mating portion and the mounting portion. The contacts are received in the passageways for connecting cables. Each latch member includes a pivot portion connected to corresponding lateral side of the insulative housing, a locking arm extending forwardly from the pivot portion and a driving portion extending backwardly from the pivot portion. The locking arms are capable of pivoting outwardly along a horizontal direction to a release status under condition that the driving portions are inwardly pressed. With the dual latch members, the electrical connector can be much reliable in locking with a mateable connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
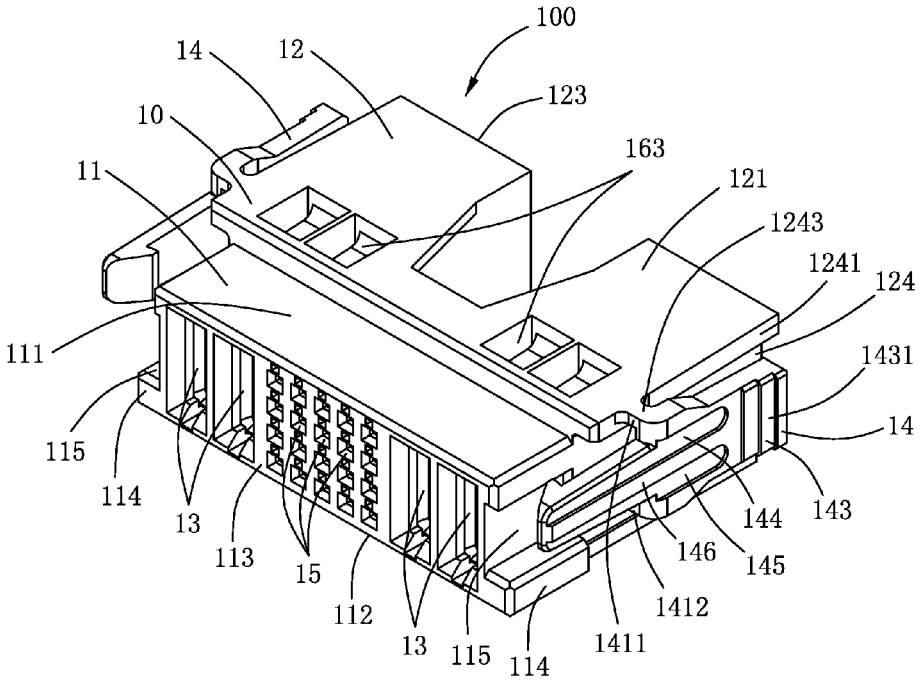
FIG. 1 is a perspective view of an electrical connector in accordance with an illustrated embodiment of the present invention.

Reference will now be made to the drawing figures to describe the embodiments of the present invention in detail. In the following description, the same drawing reference numerals are used for the same elements in different drawings.

Referring to FIGS. 1 to 7, the present invention discloses an electrical connector 100 including an insulative housing 10 and a plurality of contacts received in the insulative housing 10. The contacts include a first group of power contacts 20, a second group of power contacts 40 and a group of signal contacts 30 located between the first group of power contacts 20 and the second group of power contacts 40. According to the illustrated embodiment of the present invention, the electrical connector 100 is a cable connector with the contacts connecting to cables (not shown). The first group of power contacts 20 and the second group of power contacts 40 are symmetrically located at lateral sides of the group of signal contacts 30. The number of the power contacts 20, 40 of the first group and the second group is two. The number of the signal contacts 30 is twenty and such signal contacts 30 are averagely arranged into four rows along a vertical direction of the electrical connector 100. However, the numbers and arrangement of the power contacts 20, 40 and the signal contacts 30 cannot be limited by the illustrated embodiment and can be designed in other styles according to different requirements.

Referring to FIGS. 1, 2, 3, 6 and 7, the insulative housing 10 is essentially rectangular in shape and includes a mating portion 11 for mating with a mateable connector (not shown), a mounting portion 12 at a rear of the mating portion 11, a plurality of passageways extending through the mating portion 11 and the mounting portion 12, and a pair of latch members 14 located at lateral sides of the insulative housing 10. The mating portion 11 is lower than the mounting portion 12 in height. The passageways include a plurality of grooves 13 for receiving the power contacts 20, 40 and a plurality of holes 15 for receiving the signal contacts 30. From an integral viewpoint, the insulative housing 10 includes a pair of side walls 17 to which the latch members 14 are connected. According to the illustrated embodiment of the present invention, the insulative housing 10 is symmetrical along a central vertical plane (not shown) so that only one side of the insulative housing 10 will be described in detail hereinafter.

Figure 2:
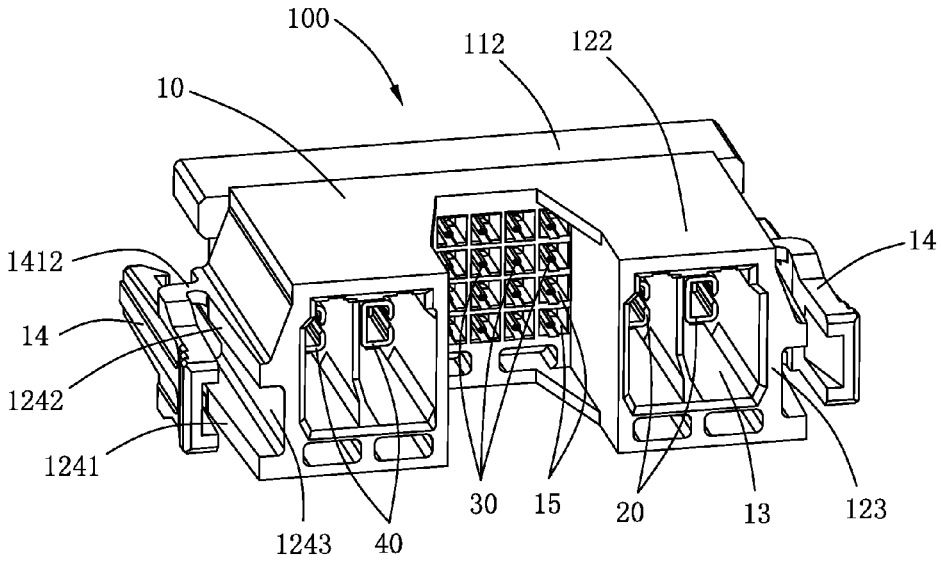
FIG. 2 is another perspective view of the electrical connector as shown in FIG. 1 while taken from a different aspect.
Figure 3:
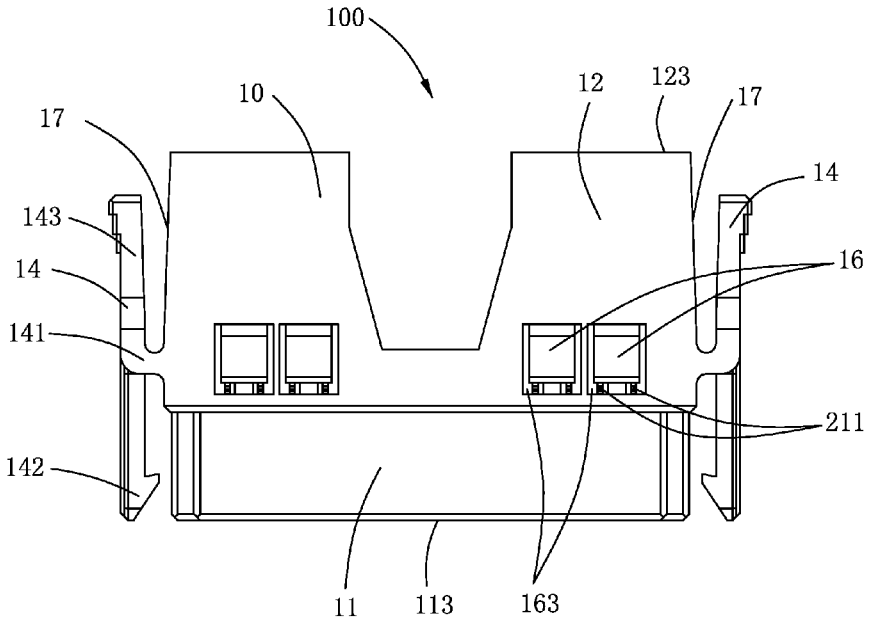
FIG. 3 is a top view of the electrical connector as shown in FIG. 1.

Referring to FIGS. 1 to 3, the mounting portion 12 is substantially of U-shape from a top view and includes a top surface 121, a bottom surface 122 opposite to the top surface 121 and a rearmost surface 123. The side walls 17 of the insulative housing 10 include a pair of first side walls 124 formed on the mounting portion 12. Each first side wall 124 includes an upper protrusion rib 1241, a lower protrusion rib 1242 and a rear cutout 1243 formed therebetween. The upper protrusion rib 1241 and the lower protrusion rib 1242 extend along a front-to-back direction.

The mating portion 11 is substantially rectangular-shaped and includes a top surface 111, a bottom surface 112 opposite to the top surface 111 and a forefront surface 113. The side walls 17 of the insulative housing 10 include a pair of second side walls 114 formed on the mating portion 11. Each second side wall 114 includes a front cutout 115 forwardly extending through the forefront surface 113 of the mating portion 11 along a rear-to-front direction. The passageways extend through the forefront surface 113 and the rearmost surface 123.

Figure 6:
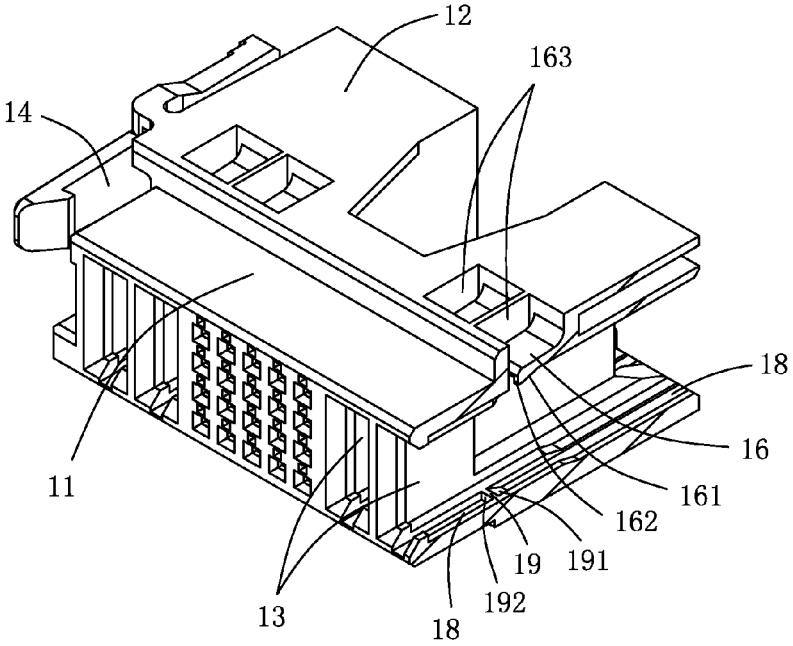
FIG. 6 is a cross-sectional view of the electrical connector before the power contact is assembled thereto.
Figure 7:
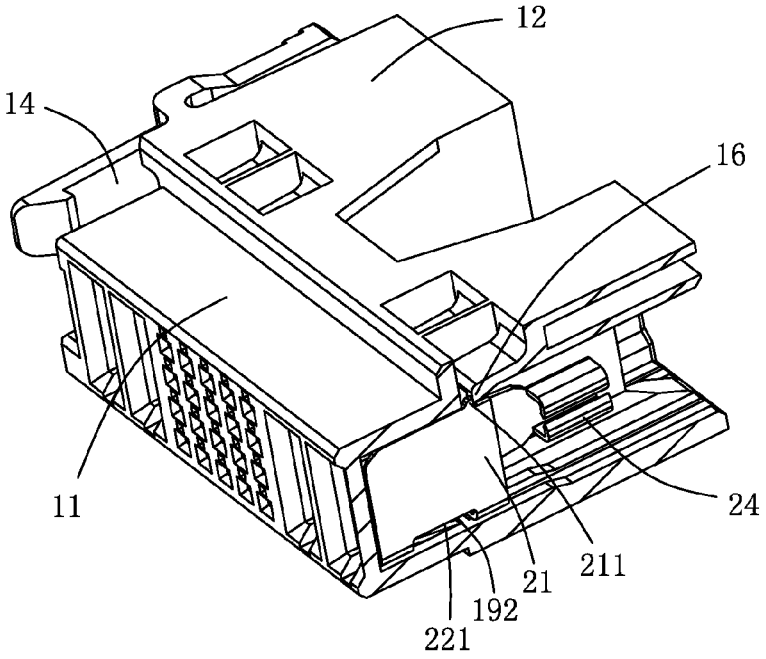
FIG. 7 is a cross-sectional view of the electrical connector after the power contact has been assembled thereto.

Referring to FIGS. 6 and 7, in order to fix the power contacts 20, 40, the mounting portion 12 includes a plurality of inclined resilient arms 16 extending into corresponding grooves 13. Besides, the mounting portion 12 includes a plurality of openings 163 in communication with corresponding grooves 13 in order to observe locking status of the power contacts 20, 40 and the inclined resilient arms 16. Each inclined resilient arm 16 includes a slant bottom surface 161 for guiding insertion of the power contacts 20, 40 and a front locking surface 162 for abutting against the power contacts 20, 40. Besides, the insulative housing 10 includes a plurality of bottom slits 18 in communication with corresponding grooves 13 and a plurality of blocks 19 in the slits 18. Each slit 18 is adapted for positioning the power contacts 20, 40. Each block 19 includes a rear slant surface 191 for guiding insertion of the power contacts 20, 40 and a front stop wall 192 for locking with the power contacts 20, 40.

Referring to FIGS. 1 to 3, each latch member 14 includes a pivot portion 141 connected to corresponding side wall 17 of the insulative housing 10, a locking arm 142 extending forwardly from the pivot portion 141 for locking or unlocking with the mateable connector, and a driving portion 143 extending backwardly from the pivot portion 141. The locking arms 142 are capable of pivoting outwardly along a horizontal direction to a release status under condition that the driving portions 143 are inwardly pressed. As shown in FIG. 3, regarding to a single side, the locking arm 142 and the driving portion 143 are outwardly separated from neighboring side wall 17 so that a reasonable space can be provided for deformation of the locking arm 142 and the driving portion 143. With the dual latch members 14, the electrical connector 100 can be much reliable in locking with the mateable connector. Besides, since the latch members 14 extend from the lateral sides of the insulative housing 10, the latch members 14 cannot be easily damaged by pressing of external force.

According to the illustrated embodiment of the present invention, the pivot portions 141 of the latch members 14 are integrally formed with the corresponding side walls 17. Each pivot portion 141 includes an upper connecting portion 1411 integrally connected to the upper protrusion rib 1241 and a lower connecting portion 1412 integrally connected to the lower protrusion rib 1242. The locking arm 142 and the driving portion 143 are located between the upper connecting portion 1241 and the lower connecting portion 1242 along the vertical direction from a side view of the electrical connecter 100. Besides, the upper connecting portion 1241 and the lower connecting portion 1242 are essentially perpendicular to the locking arm 142 and the driving portion 143. As shown in FIG. 1, the upper connecting portion 1241 includes a top surface 1243 coplanar with the top surface 121 of the mounting portion 12. Each latch member 14 includes a top recess 144, a bottom recess 145 and a middle rib 146 thereby formed between the top recess 144 and the bottom recess 145. The top recess 144 and the bottom recess 145 extend throughout the locking arm 142 and the pivot portion 141 along the front-to-rear direction and ultimately approach the driving portion 143. The driving portion 143 is wider than the locking arm 142. The driving portion 143 includes a plurality of ribs 1431 for enhancing friction in using. Under this configuration, the elasticity of the locking arm 142, the strength of the pivot portion 141, and the rigidity of the driving portion 143 can be well balanced. Besides, the latch members 14 are located between the forefront surface 113 and the rearmost surface 123 along the front-to-rear direction and between the top surface 121 and the bottom surface 122 of the mounting portion 12. As a result, the whole profile of the electrical connector 100 can be well controlled.

Figure 4:
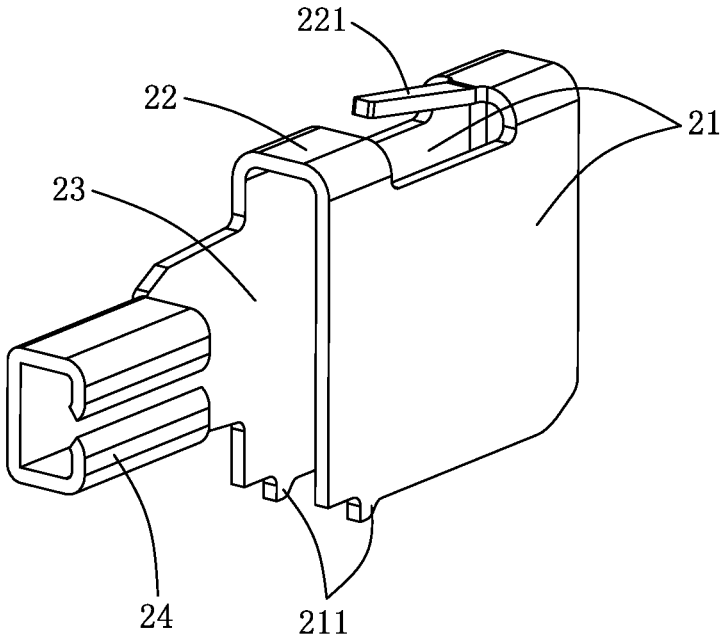
FIG. 4 is a perspective view of a power contact of the electrical connector as shown in FIG. 1.
Figure 5:
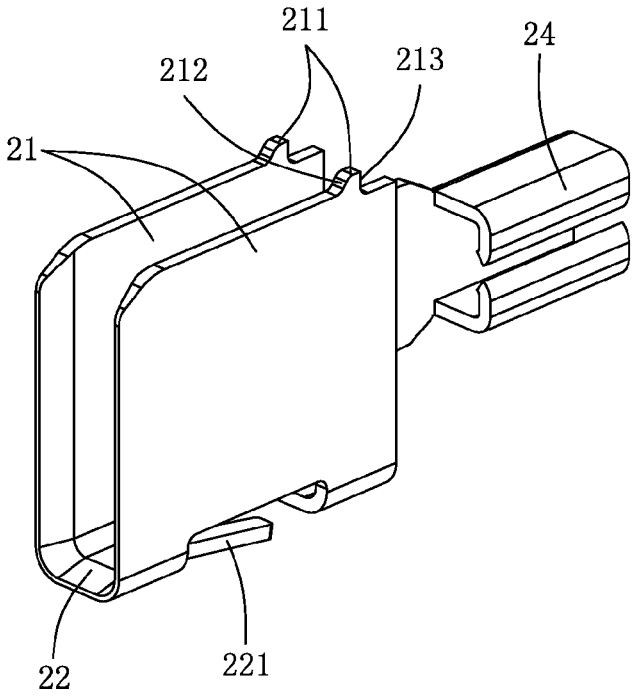
FIG. 5 is another perspective view of the power contact as shown in FIG. 4 while taken from a different aspect.

Referring to FIGS. 4, 5 and 7, each power contact 20, 30 includes a pair of parallel contacting plates 21, a connecting portion 22 connecting the contacting plates 21, an extending portion 23 extending from one of the contacting plates 21, and a frame-shaped portion 24 extending from the extending portion 23 for connecting the cables. According to the illustrated embodiment of the present invention, each contacting plates 21 includes a rigid protrusion 211 extending upwardly therefrom. The protrusion 211 includes a front slant surface 212 for guiding insertion and a rear locking surface 213 for restriction. Besides, the connecting portion 22 includes a resilient tab 221 stamped downwardly therefrom and opposite to the protrusions 211.

As shown in FIGS. 6 and 7, with insertion of the power contacts 20, 40 into the grooves 13 along the rear-to-front direction, the front slant surface 212 engages with the slant bottom surface 161 to upwardly deform the resilient arm 16. Simultaneously, the resilient tab 221 engages with the rear slant surface 191 and is upwardly deformed. Under the guidance of slant/inclined features, the protrusions 211 ultimately get over the resilient arm 16 and the resilient tab 221 ultimately gets over the block 19. As a result, the resilient arm 16 releases its elasticity to make the rear locking surface 213 abutting against the front locking surface 162, and simultaneously, the resilient tab 221 releases its elasticity to make a rear end of the resilient tab 221 abutting against the front stop wall 192. As a result, the resilient tab 221 and the protrusions 211 are restricted in the insulative housing 10 so that the power contacts 20, 40 are prevented from withdrawing the insulative housing 10.

Referring to FIG. 7, from another viewpoint, according to the illustrated embodiment of the present invention, both top and bottom sides of the power contacts 20, 40 are lockable in the insulative housing 10 via a rigid feature and a resilient feature as a result that the power contacts 20, 40 can be well held in the grooves 13. In detail, one of the top stop member (i.e. the resilient arm 16) and the top engaging member (i.e. the protrusions 211) is resilient and the remaining one of the top stop member and the top engaging member is rigid, and one of the bottom stop member (i.e. the block 19) and the bottom engaging member (i.e. the resilient tab 221) is resilient and the remaining one of the bottom stop member and the bottom engaging member is rigid.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an insulative housing comprising a mating portion, a mounting portion at a rear of the mating portion and a plurality of passageways extending through the mating portion and the mounting portion;

a plurality of contacts received in the passageways for connecting cables; and a pair of latch members located at lateral sides of the insulative housing, each latch member comprising a pivot portion connected to corresponding lateral side of the insulative housing, a locking arm extending forwardly from the pivot portion and a driving portion extending backwardly from the pivot portion; wherein the locking arms are capable of pivoting outwardly along a horizontal direction to a release status under condition that the driving portions are inwardly pressed;

wherein the insulative housing comprises a pair of side walls, the pivot portions of the latch members being integrally formed with corresponding side walls, the locking arm and the driving portion being outwardly separated from neighboring side wall;

wherein each pivot portion comprises an upper connecting portion and a lower connecting portion, the locking arm and the driving portion being located between the upper connecting portion and the lower connecting portion along a vertical direction from a side view of the electrical connector.

2. The electrical connector as claimed in claim 1, wherein the upper connecting portion and the lower connecting portion are essentially perpendicular to the locking arm and the driving portion.

3. The electrical connector as claimed in claim 1, wherein each side wall comprises an upper protrusion rib, a lower protrusion rib and a cutout formed between the upper protrusion rib and the lower protrusion rib, the upper protrusion rib and the lower protrusion rib extending along a front-to-back direction, the upper connecting portion and the lower connecting portion respectively connected to the upper protrusion rib and the lower protrusion rib.

4. The electrical connector as claimed in claim 3, wherein the side walls comprise a pair of first side walls formed on the mounting portion, the upper protrusion rib and the lower protrusion rib being respectively integral with the first side walls, top surfaces of the mounting portion and the upper connecting portion being coplanar with each other.

5. The electrical connector as claimed in claim 4, wherein the mating portion is lower in height than that of the mounting portion, the side walls comprising a pair of second side walls formed on the mating portion, each second side wall defining a cutout forwardly extending through a forefront surface of the mating portion.

6. The electrical connector as claimed in claim 1, wherein each latch member comprises a top recess, a bottom recess and a middle rib thereby formed between the top recess and the bottom recess, the top recess and the bottom recess extending throughout the locking arm and the pivot portion along a front-to-rear direction and approaching the driving portion.

7. The electrical connector as claimed in claim 1, wherein the mating portion and the mounting portion define a front surface and a rear surface, respectively, the passageways extending through the front surface and the rear surface, the latch members being located between the front surface and the rear surface.

8. The electrical connector as claimed in claim 1, wherein the driving portion is wider than the locking arm, and the driving portion comprises a plurality of ribs for enhancing friction.

9. The electrical connector as claimed in claim 1, wherein the contacts comprise a first group of power contacts, a second group of power contacts and a group of signal contacts located between the first group of power contacts and the second group of power contacts.

10. The electrical connector as claimed in claim 9, wherein each power contact comprises a pair of parallel contacting plates, a connecting portion connecting the contacting plates, an extending portion extending from one of the contacting plates, and a frame-shaped portion extending from the extending portion for connecting the cables.

11. The electrical connector as claimed in claim 10, wherein the connecting portion comprises a resilient tab stamped downwardly therefrom, each contacting plate comprising a protrusion opposite to the resilient tab, the resilient tab and the protrusions are restricted in the insulative housing so that the power contacts are prevented from withdrawing the insulative housing.

12. The electrical connector as claimed in claim 11, wherein the insulative housing comprises a slit in communication with the passageway to jointly receive the contacting plates, a stop wall exposed in the slit and an inclined resilient arm extending into the passageway, the resilient tab and the protrusions being lockable with the stop wall and the inclined resilient arm, respectively.

13. An electrical connector comprising:

an insulative housing comprising a mating portion, a mounting portion and a plurality of passageways extending through the mating portion and the mounting portion along a front-to-rear direction;

a plurality of power contacts assembled to the passageways along a rear-to-front direction; and a pair of latch members located at lateral sides of the insulative housing for locking or unlocking with a mateable connector; wherein the insulative housing comprises a top stop member and a bottom stop member in communication with and corresponding to each passageway, and each power contact comprises a top engaging member and a bottom engaging member locking with the top stop member and the bottom stop member, respectively, so that the power contacts are prevented from withdrawing the passageways along the front-to-rear direction; and wherein one of the top stop member and the top engaging member is resilient and the remaining one of the top stop member and the top engaging member is rigid, and one of the bottom stop member and the bottom engaging member is resilient and the remaining one of the bottom stop member and the bottom engaging member is rigid.

14. The electrical connector as claimed in claim 13, wherein the top stop member comprises an inclined resilient arm integrally with the mounting portion, and the top engaging member comprises a pair of rigid protrusions simultaneously locking with the inclined resilient arm.

15. The electrical connector as claimed in claim 14, wherein each power contact comprises a pair of parallel contacting plates, a connecting portion connecting the contacting plates, an extending portion extending from one of the contacting plates, and a frame-shaped portion extending from the extending portion, the pair of rigid protrusions being respectively formed on top of the contacting plates, the bottom stop member comprising a stop wall, the bottom engaging member comprising a resilient tab stamped downwardly from the connecting portion to lock with the stop wall.

16. The electrical connector as claimed in claim 13, wherein each latch member comprises a pivot portion integrally formed with corresponding lateral side of the insulative housing, a locking arm extending forwardly from the pivot portion and a driving portion extending backwardly from the pivot portion, the locking arms being capable of pivoting outwardly along a horizontal direction to unlock with the mateable connector under condition that the driving portions are inwardly pressed.

17. The electrical connector as claimed in claim 16, wherein each pivot portion comprises an upper connecting portion and a lower connecting portion, the locking arm and the driving portion being located between the upper connecting portion and the lower connecting portion along a vertical direction from a side view of the electrical connector.

18. The electrical connector as claimed in claim 17, wherein each side wall comprises an upper protrusion rib, a lower protrusion rib and a cutout thereby formed between the upper protrusion rib and the lower protrusion rib, the upper protrusion rib and the lower protrusion rib extending along the front-to-rear direction, the upper connecting portion and the lower connecting portion connected to the upper protrusion rib and the lower protrusion rib, respectively.

19. An electrical connector comprising:

an insulative housing comprising a mating portion, a mounting portion at a rear of the mating portion and a plurality of passageways extending through the mating portion and the mounting portion;

a plurality of contacts received in the passageways for connecting cables; and a pair of latch members located at lateral sides of the insulative housing, each latch member comprising a pivot portion connected to corresponding lateral side of the insulative housing, a locking arm extending forwardly from the pivot portion and a driving portion extending backwardly from the pivot portion; wherein the locking arms are capable of pivoting outwardly along a horizontal direction to a release status under condition that the driving portions are inwardly pressed;

wherein each latch member comprises a top recess, a bottom recess and a middle rib thereby formed between the top recess and the bottom recess, the top recess and the bottom recess extending throughout the locking arm and the pivot portion along a front-to-rear direction and approaching the driving portion.

* * * * *